US005389207A

United States Patent [19]

Rodriguez et al.

[11] Patent Number: 5,389,207

[45] Date of Patent: Feb. 14, 1995

[54] APPARATUS FOR CONTROLLING THE DEWATERING OF A WEB IN A FOURDRINIER FABRIC

[76] Inventors: Peter A. Rodriguez, 1785 Selva Marina Dr., Atlantic Beach, Fla. 32233; Glauco Corbellini, 33100 Via Carducci 48, Udine, Italy

[21] Appl. No.: 234,627

[22] Filed: Apr. 28, 1994

Related U.S. Application Data

[63] Continuation of Ser. No. 24,906, Mar. 3, 1993, abandoned, which is a continuation of Ser. No. 845,674, Mar. 4, 1992, abandoned, which is a continuation-in-part of Ser. No. 717,880, Jun. 17, 1991, Pat. No. 5,242,547, which is a continuation of Ser. No. 384,744, Jul. 24, 1989, abandoned.

[51] Int. Cl.[6] ..... D21F 1/48

[52] U.S. Cl. ..... 162/363; 162/217; 162/301; 162/364; 162/374

[58] Field of Search ..... 162/301, 351, 352, 374, 162/363, 364, 217

[56] References Cited

U.S. PATENT DOCUMENTS

| | | | |
|---|---|---|---|
| 2,991,218 | 7/1961 | Cirrito et al. | 162/370 |
| 3,066,068 | 11/1962 | Calehuff | 162/208 |
| 3,489,644 | 1/1970 | Rhine | 162/354 |
| 3,573,159 | 3/1971 | Sepall | 162/208 |
| 4,306,934 | 12/1981 | Seppanen | 162/351 |
| 4,474,296 | 5/1984 | Cruse | 162/352 |
| 4,769,111 | 9/1988 | Nevalainen et al. | 162/300 |
| 5,011,577 | 4/1991 | Hansen et al. | 162/352 |

FOREIGN PATENT DOCUMENTS

| | | | |
|---|---|---|---|
| 9101408 | 2/1991 | WIPO | 162/351 |

OTHER PUBLICATIONS

Baumann, "New Top Wire Forming Unit Provides Flexibility", Pulp and Paper, Apr. 1989.

*Primary Examiner*—Karen M. Hastings
*Attorney, Agent, or Firm*—Arthur G. Yeager

[57] ABSTRACT

Improved apparatus for controlling the dewatering of a web (44, 44') in a Fourdrinier fabric (20, 21) by submerged drainage apparatus in which air does not penetrate through the fiber/aqueous dispersion nor the formed web (44, 44'). The dewatering is accomplished by altering the natural tension of the meniscus of the water to induce enhanced drainage of water from the aqueous dispersion of paper making fibers in the fabric (20, 21) and replacement air for the water draining from the formed web (44, 44') is provided from beneath the lower fabric (20) and, if an upper fabric (21) is employed, from above the upper fabric (21).

20 Claims, 6 Drawing Sheets

APPARATUS FOR CONTROLLING THE DEWATERING OF A WEB IN A FOURDRINIER FABRIC

RELATED PATENT APPLICATIONS

This is a continuation of application Ser. No. 08/024,906, filed on Mar. 3, 1993, now abandoned, which was a continuation of Ser. No. 07/845,674, filed Mar. 4, 1992, now abandoned, which was a continuation-in-part of patent application Ser. No. 07/717,880, filed Jun. 17, 1991, now U.S. Pat. No. 5,242,547, which was a continuation of Ser. No. 07/384,744, filed Jul. 24, 1989, now abandoned.

TECHNICAL FIELD

This invention relates to the technical art of papermaking and to the machinery used in that art.

BACKGROUND OF THE INVENTION

Modern paper making processes and machinery follow the Fourdrinier method wherein an aqueous dispersion of paper making fibers is poured onto a high speed traveling woven fabric through which water from the dispersion drains leaving a thin web of wet fibers which is dried and finished to a sheet of paper. The key step in this method is that of forming the web from the fiber-/aqueous dispersion. This must be done very quickly and uniformly across the width of the endless fabric. Normally, the transition of dewatering commences by gravity, followed by other means such as foil blades, continuing with a plurality of controlled low vacuum boxes and then by a plurality of high vacuum boxes. There are many causes for mishaps to occur that prevent the final sheet of paper from being perfect. One of the principal causes is that air may penetrate the web off paper and the fabric causing nonuniformities in the paper. Such disturbances may be caused by nonuniform drainage at every square inch of the fabric surface, and entrainment of air in the fiber/aqueous dispersion, followed by forcing air through the dispersion and fabric whereby air will find the path of least resistance and fixing the flocculation of such dispersion unevenly over the fabric. The demand for higher and higher speed makes it increasingly difficult to produce a paper sheet that is isotropic.

The critical step of this process is the water removal, which must be done quickly and uniformly in order to obtain a layer of fibers on the fabric that can be finished to a high quality paper. The principal difficulty in producing a fast, uniform drainage has been that when the drainage is speeded up by applying a vacuum there are numerous instances at random locations across the fabric where air will be pulled through the layer of wet fibers. At each location a small vortex appears to break the continuity of the film of water and fiber on the fabric, and to permit the passage of air through the entire film and thereby disrupting the uniform settling of the fibers into a web of uniform thickness and strength. Every time such an instance occurs, a meniscus is formed at the interface of the water and air and this is an obstruction to the free uniform flow of water away from the fibers forming the web. The formation of such air holes through the mass of fibers forming the web must be minimized if any improvement in sheet formation at high speed is to be achieved.

An improved method and apparatus for sheet formation in the Fourdrinier paper is disclosed in our copending U.S. patent application Ser. No. 07/717,880 filed Jun. 17, 1991, now U.S. Pat. No. 5,242,547. That patent describes an improved procedure for maintaining a continuous drainage of water with substantially no air flow discontinuities occurring in the forming web. The apparatus described in that application relates primarily to the wetter end of the web immediately following the head box.

It is an object of this invention to provide an apparatus especially suited for use downstream of the head box and the wetter drainage box or boxes and upstream of the couch roll. One of the advantages of this invention is to decrease the amount of friction between the fabric and the dewatering components and to give the fabric a longer useful life. Another advantage is to substantially reduce the length of the forming area of the fabric, and thereby to reduce the number of dewatering components required.

Other advantages include:

A. retention of more chemical additives and fines due to the more gentle dewatering and uniformity of dewatering;

B. easier release of web from the fabric due to the web not being forced into the interstices of the fabric by high vacuum whereby a web pick-up vacuum roll or high pressure air from below the fabric not needed;

C. amount of defoamer is reduced;

D. enhanced sheet strength; and

E. enhanced drying at the end of the fabric (couch roll) thus reducing the power used in the pressing and/or the drying sections. Still other objects will appear from the more detailed description which follows.

BRIEF SUMMARY OF THE INVENTION

These definitions may be used in understanding this invention:

A. Meniscus is the surface of a water volume which is in contact with a dissimilar surface. The dissimilar surface may be the container holding the water or the gases in contact with a surface of the water or surrounding the water, such as air when a drop of water is falling through it. *Webster's New International Dictionary, 2nd Edition, Unabridged,* 1934 defines Meniscus as —the curved upper surface of a liquid column that is concave when the containing walls are wetted by the liquid and convex when not. The meniscus is present at the interface between the liquid and the vessel in which it is contained.

B. Surface Tension is a condition that exists at the free surface film of a liquid by reason of intermolecular forces about the individual surface molecules and is manifested by properties resembling those of an elastic skin under tension. Surface Tension is a characteristic of the waiter meniscus which can be modified by chemical means. The meniscus changes its geometric (concave shape depending on the Surface Tension of the liquid.

This invention relates to a submerged drainage apparatus for removing water from a wet weld of paper making fibers and moving Fourdrinier fabric having a drier end downstream of a wetter end, an outer surface, and an inner surface. The apparatus comprises a plurality of spaced elongated stationary first dewatering meniscus tension units along the wetter end of the fabric and a plurality of spaced elongated stationary second drainage multicell wire or fabric meniscus separator units along the drier end of the fabric. Each cell of the second drainage multicell wire meniscus separator unit has a drainage surface in continuous contact with the inner surface of the fabric, a web formed from an aqueous dispersion of paper making fibers supported on the outer surface of the fabric and above the second drainage separator units, each cell of which has an internal space for discharging a volume of water and air from the space extending to and in contact with the inner surface of the fabric. The drainage units in each cell has one passageway for conducting air to its drainage surface and to the inner surface of the fabric, and another passageway communicating over the drainage surfaces with the other passageway through interstices of the fabric. There also is a means for applying a small vacuum to the internal space of the second drainage separator unit to modify the natural tension of meniscus of water in the fabric so as to induce by capillary forces enhanced drainage of water from the paper web to the fabric and then into the internal space, and means for discharging the water from that internal space.

In one preferred embodiment of this invention a web is formed from the aqueous dispersion of paper making fibers supported on the outer surface above the drainage multicell wire meniscus separator units each drainage unit including a plurality of cells each having an internal space for containing a volume of water and air with each cell extending to and in contact with the inner surface of the fabric. A passageway from the drainage surface of the separator units to the internal space of each cell conducts air and/or water from the inner surfaces of the fabric to internal spaces of the cells. Another passageway conducts air to tile drainage surface, and a small vacuum is applied to the internal spaces of the cells to induce enhanced drainage of water from the interstices of the fabric reducing the meniscus tension of the water in the fabric and requiring the web to regenerate by capillary forces the void in the fabric caused by water drainage during its passage over each cell without air passing through the web.

Additional aspects are provided by each cell having a nose with a horizontal planar surface over which the inner surface of the fabric slides. A first passageway is at an acute angle with the planar surface to conduct air to the inner surface of the fabric in the same direction as the movement of the fabric, and air into the interstices of fabric itself. A second passageway is at an acute angle with the planar surface to conduct air and water away from the inner surface of the fabric into the internal space thereby minimizing any air being passed through the web. A source of steam preferably is used to heat the air passing through the first passageway to enhance water drainage from the web.

The invention specifically includes apparatus for removing water, particularly the drier end of a wet web by passing the fabric and wet web of fibers over and in contact with a submerged drainage multicell wire meniscus separator unit having a plurality of adjacent cells and containing a small vacuum to assist in extracting water and air from the fabric, and permitting air from the atmosphere to be introduced into the interstice of the fabric from below the fabric to enhance the removal of water from the fabric by capillary forces and water from the web. The air is introduced upstream from the small vacuum whereby the air travels in the same direction as and in the interstices of the fabric and enhances the removal of water from the web. Steam also may be applied to further enhance water removal from the web. The apparatus preferably includes a second fabric on top of the wet web moving in the same direction as the fabric, and with a plurality of drainage separator units above the second fabric removing water and air from that side of the web to produce a paper web therefrom having substantially the same characteristics on each outer surface thereof.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

On the surface of the Fourdrinier fabric 20 the meniscus infiltrates the interstices or meshes and produces several phenomena, one being that while a dry fabric is easily penetrated by air, the same fabric, when wet, will be difficult to penetrate by air and yet easily penetrated by the water. Since the film of the meniscus attaches to the fabric, it allows the passage of water, the meniscus itself being water. However, before air can pass through the fabric the meniscus layer must first be ruptured by a certain level of air pressure considered here as tension of the meniscus of water.

The features of this invention are best understood by reference to the attached drawings.

Figure 1:
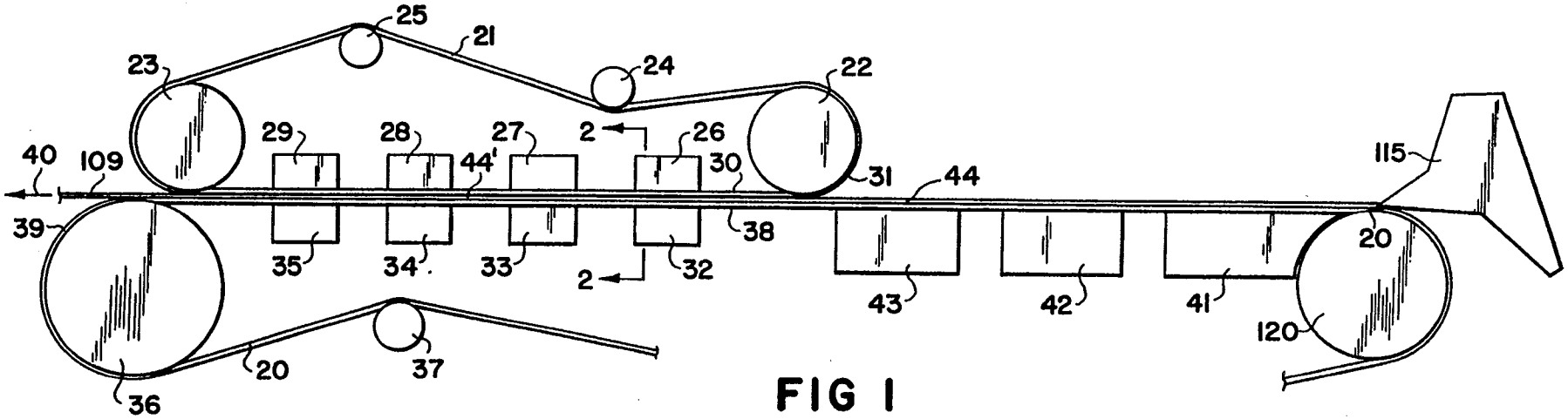
FIG. 1 is an overall schematic side elevational view of the system of this invention using two Fourdrinier fabrics.

A Fourdrinier paper making machine of the prior art is somewhat similar to the lower half of the apparatus of FIG. 1 wherein a woven fabric 20 travels horizontally in the direction of arrow 40 and passing over the top of several devices in locations such as those shown at 41, 42, 43, 32, 33, 34 and 35 to remove water from a layer of a fiber/aqueous dispersion 44 fed to the top of fabric 20 by a head box 115 and to leave a self-supporting web of wet fiber at 109 which can be taken from the fabric 20 and processed through drying, pressing, and finishing operations to become a sheet of paper. The water removal devices of the prior art are normally boxes with a top cover of approximately 40–50% open area over which fabric 20 passes and with the interior of the box at subatmospheric pressure so as to suction water and/or air through the fabric 20 into the box for water removal. Generally, such boxes are fashioned with a plurality of parallel slots and/or holes and blades or foils, which are inclined against the direction of movement 40 of fabric 20 so as to cause water beneath the fabric to flow more readily through and away from the fabric 20. The purpose of such action is to essentially wipe away any bubble or any drops or hanging water below the bottom of fabric 20 and thereby seeking to maintain a flow of water draining out of the dispersion on the top of fabric 20 against the resistance formed by the meniscus of water attached along the interstices of the fabric. The drainage without the resistance by the meniscus of water is referred to as "submerged drainage", and is described and claimed in our U.S. Pat. No. 5,242,547, with particular reference to the wetter end of the fabric where drainage boxes 41, 42 and 43 (FIG. 1) are located.

This invention is directed to an improved design for a drainage multicell wire meniscus separator units, e.g., 26–29 and 32–35, for the drier end of the Fourdrinier machine to be used in place of the high vacuum flat suction boxes of the prior art. As mentioned above the lower part of FIG. 1 is somewhat similar to the arrangement employed in the prior art Fourdrinier paper making system, but without the improved submerged drainage multicell wire meniscus separator units, etc., set forth herein. FIG. 1 shows a system employing drainage multicell separator units 26–29 above the paper web 44' and drainage multicell separator units 32–35 below the paper web 44' operating simultaneously to dry web 44' for finishing operations after passing beyond rolls 23 and 36. Upper Fourdrinier fabric 21 has an outer surface 31 in contact with the upper surface of the web 44', which has now formed by the prior dewatering operation acting on aqueous dispersion 44, so as to have fabric 20 below the web 44' and fabric 21 above the web 44'. Both fabrics 20 and 21 are horizontal with the dispersion 44 and web 44' supported on lower fabric 20 and both fabrics 20 and 21 are made to run in the same direction 40 where they are closely parallel to each other. Since each fabric 20 and 21 is separate and distinct and is endless length, they must each be driven, guided, and tensioned by separate sets of rollers. Upper fabric 21 is driven through its course with its inner surface 30 in contact with drive roller 23, return roller 22, tension roller 24, and guide roller 25, and its outer surface 31 in contact with web 44'. A similar set of rollers is needed for fabric 20 although only drive couch roller 36, breast roller 120, and tension roller 37 are shown in contact with inner surface 38, while outer surface 39 is in contact with web 44'. This portion of the process of the web 44' is subjected to submerged drainage although separator units 26–29 and 32–35 are of a different design than that of boxes 41–43 in the wetter end of the system. Upper fabric 21 is in contact with upper drainage separator units 26, 27, 28 and 29, while lower fabric 20 is in contact with lower drainage multicell units 32, 33, 34 and 35.

Figure 2:
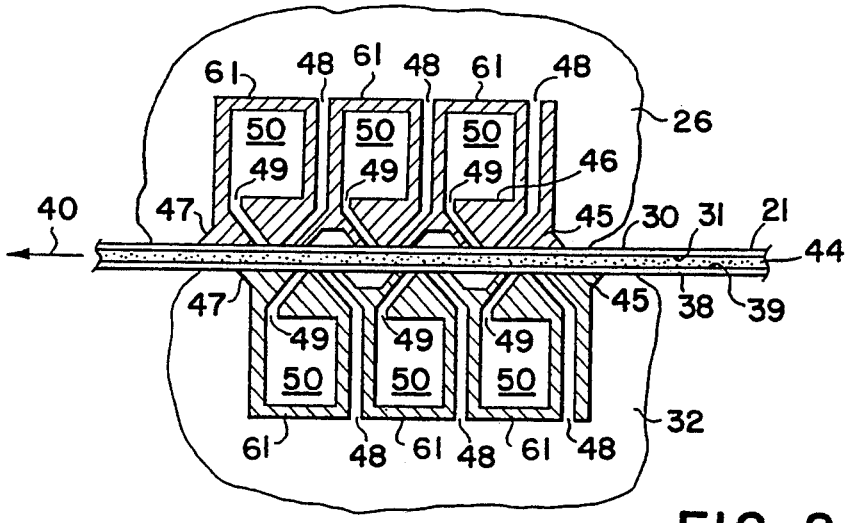
FIG. 2 is a cross sectional view of one embodiment of a drainage multicell wire meniscus separator unit taken at 2—2 of FIG. 1.
Figure 3:
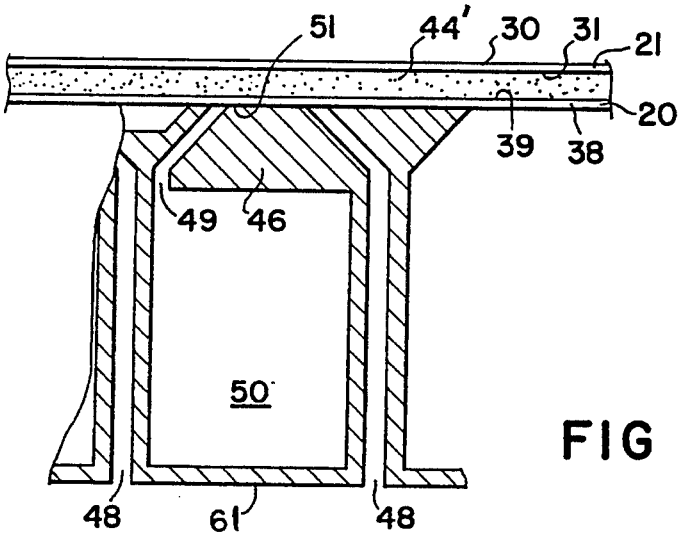
FIG. 3 is an enlarged cross sectional view of a portion of the drainage multicell separator unit of FIG. 2.
Figure 4:
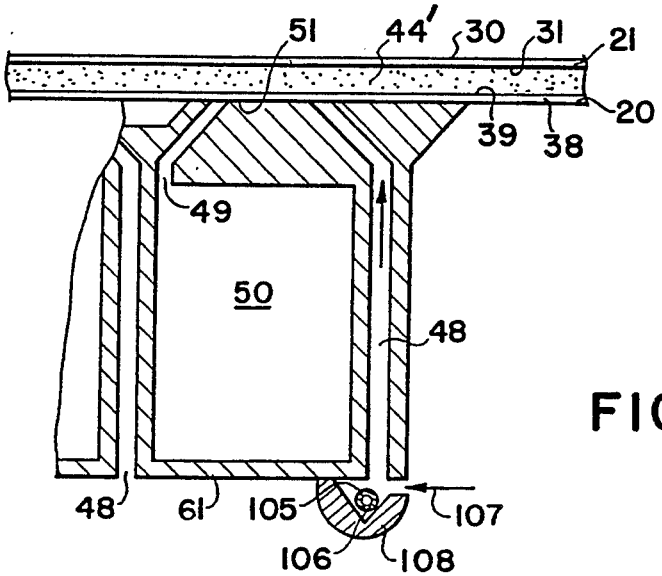
FIG. 4 is a front elevational view identical to that of FIG. 3 except to include an improvement in the air inlet portion.

Both upper and lower submerged drainage separator units are made of a plurality of adjacent drainage cells 61, as shown in FIGS. 2–5 or 5–10. In the embodiment of FIGS. 2–5 each cell is constructed generally to have a central vacuum chamber 50 maintained at subatmospheric pressure, a nose 51 in sliding contact with the inside surface (38 of fabric 20 or 30 of fabric 21) with inclined passageways 48 and 49 leading toward and away from nose 51. Three such cells 61 are shown in FIG. 2 extending laterally across fabrics 20 and 21. One end of each vacuum chamber 50 is opened into an individual conduit or manifold which is attached to a means for supplying a vacuum and separating air from the water, preferably as shown in our U.S. Pat. No. 5,242,547. The other end of vacuum chamber 50 is closed. As air and water is suctioned through passageway 49 into chamber 50, air from the surrounding atmosphere flows into passageway 48 to pass over nose 51 and through the interstices of the fabric 20 below or the fabric 21 above. So long as water is being sucked from the fabric 20 and 21 the meniscus of water of the surface of the web 44' in contact with each fabric 20 and 21 transfers the water therefrom to the respective fabric 20 and 21, repeating the action until the energy of meniscus in the fabric by capillary forces is unable to extract residual water from the web. The vacuum that is needed for this operation is low and only about 3 inches of Hg. generally for most fabric speeds, but this is sufficient to permit drainage boxes 26, 27, 28 and 29 to even function upside down on upper fabric 21. This is in sharp contrast to the high vacuum of the prior art which may be at about 5–12 inches of Hg. which is required for air penetration of the web. Also, an appropriate discharge from one end of each of the chambers or cells 61 is provided to discharge the water therefrom in any well-known manner such as that mentioned above. The combination of three rows of cells 61, as shown in FIG. 2, includes a lead deflector surface 47, all being stationary surfaces over which the moving fabric 20 or fabric 21 travels. Such surfaces are needed to support the fabric 20 and 21 in a smooth stable manner. In one improved embodiment as shown in FIG. 4 a pipe 105 carrying steam to spray downwardly at 106 enhances the operation by heating the air entering passageway 48 and thereby heating tile water in web 44 causing its viscosity to be lowered and thereby making it flow more rapidly through fabric 20 or 21. An insulated reflector 108 is shown to protect against loss of the heat before it is sprayed at 106. The entrance of air into passageway 48 is permitted by opening 107 through reflector 108.

As shown in FIG. 2 the upper drainage separator units with cells 61 are horizontally offset from the lower drainage units with cells 61 so that a small vacuum is not applied to each side of the paper web at the same time at a particular location. If this were not so, it is likely that air would occasionally pass through and damage the paper web. Also, the spacing or tolerance between the upper and lower fabrics might cause damage thereto on account of entrained debris in the web and to inhibit such damage the water is not withdrawn from the web simultaneously vertically at any particular location spaced along the two fabrics.

Figure 10:
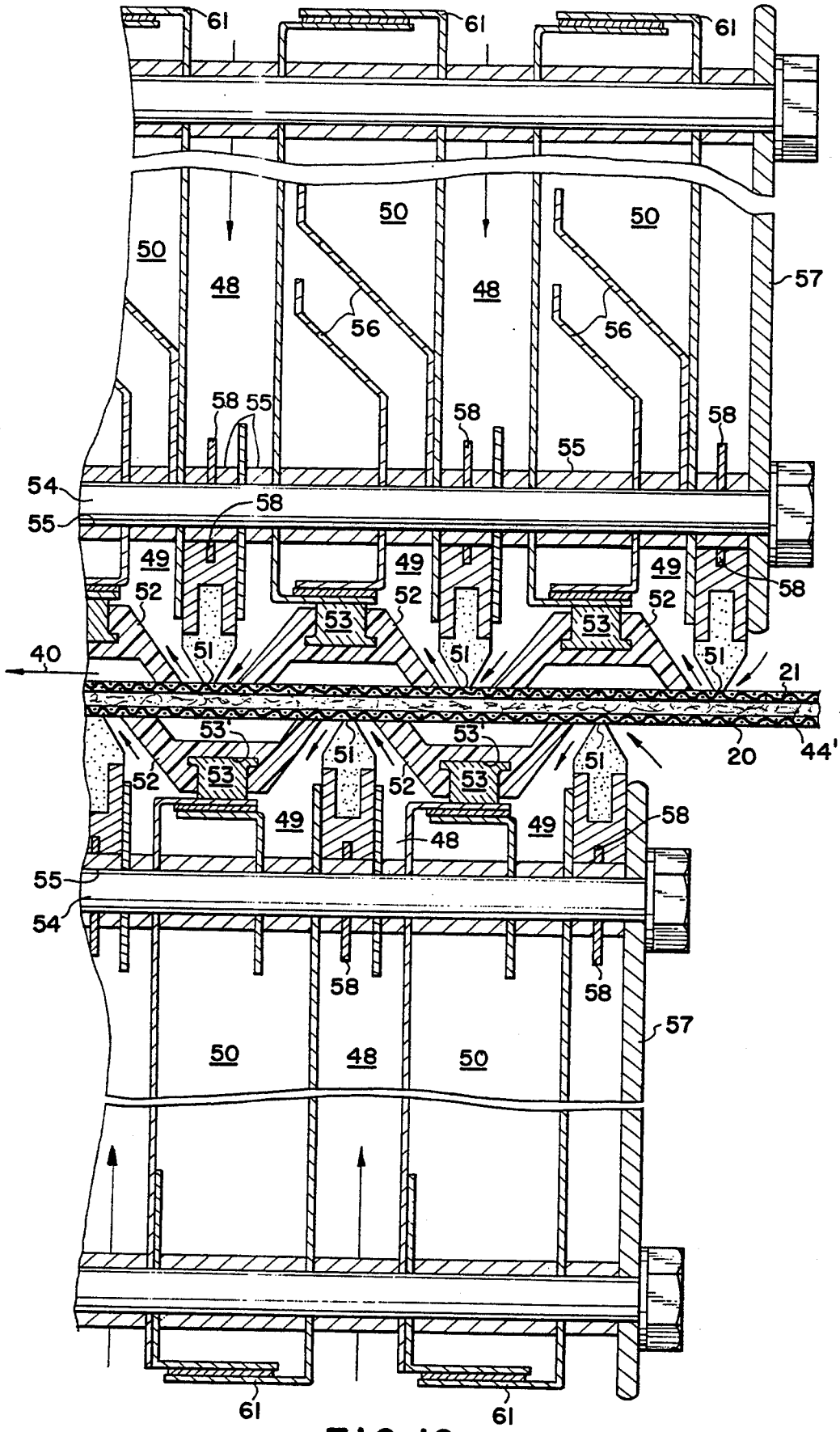
FIG. 10 is an enlarged cross sectional view of the second embodiment of a drainage multicell separator unit similar to FIG. 2.

In FIGS. 5–10 there is shown a second embodiment of submerged drainage separator units 26–29 and 32–35. Each of those drainage separator units is a combination of a plurality, preferably 3–5, of cells 61 having the same general arrangement and function as those described above with respect to FIGS. 2–4. In FIG. 10 there is a detailed illustration of a combination of cells like that of FIG. 2 described above. FIG. 10 shows 3–4 cells 61 positioned above and in contact with upper fabric 21 and a similar number of cells 61 positioned below and in contact with lower fabric 20 while web 44′ may be slightly pressed between fabrics 20 and 21, all of which is moving in the direction of arrow 40. Each cell 61 includes an internal vacuum chamber 50 which receives air and water suctioned out of fabric 20 or 21 passing in contact with nose 51 and then through passageway 49 to chamber 50. To replace the air and water removed from web 44′ and fabric 20 or 21 there is an air inlet 48 conducting air to nose 51. Each cell 61 has a nose 51 with a horizontal planar surface over which the inner surface of fabric 20 slides. The first passageway means 48 is at an acute angle with the planar surface of the nose to conduct air between the inner and outer surfaces of fabric 20 in the same direction as the movement of fabric 20. The second passageway means 49 is at an acute angle with the planar surface of nose 51 to conduct air and/or water away from the outer and inner surfaces of fabric 20 and the inner surface of the web 44′ into the chamber in the form of an internal space 50. Each cell 61 is a thin long container extending from one side to the other of the fabrics 20 and 21, and thus may be twenty or more feet long. Cells 61 above web 44′ and in contact with fabric 21 are identical to those below fabric 20, except for the presence of baffles 56 around the end of outlet passageway 49. Baffles 56 serve merely to prevent water droplets which form in chamber 50 from falling back into passageway 49. A cluster of cells 61 is held together by a plurality of tie rods 54 extending through the cells and their support plates 57 at both ends. In order to seal the internal vacuum in chamber 50 from leaking around tie rods 54, a plurality of sleeve members 55 are employed under compression from tightening the nuts on tie rods 54. Deflectors 52 are detachably secured to cells 61 by way of a T-shaped key lock 53 which cooperates with a T-shaped keyway slot 53′ in deflector 52 to permit deflector 52 to be attached to cell 61 by sliding over keylock member 53. Nose piece 51 is preferably a ceramic molding which must be replaced from time to time because of wear caused by contact with travelling fabric 20 or 21. Nose piece 51 and its base support are designed to be easily removable by reason of being attached to a thin support plate 58 which contains a C-slot 59 to engage upper tie rod 54. Therefore, the replacement of a new nose piece 51 can be accomplished by loosening the nut on upper tie rod 54, sliding nose piece 51 and its support plate 58 horizontally to unhook C-slot 59 from tie rod 54 and replacing the entire assembly by reversing those steps.

Figure 5:
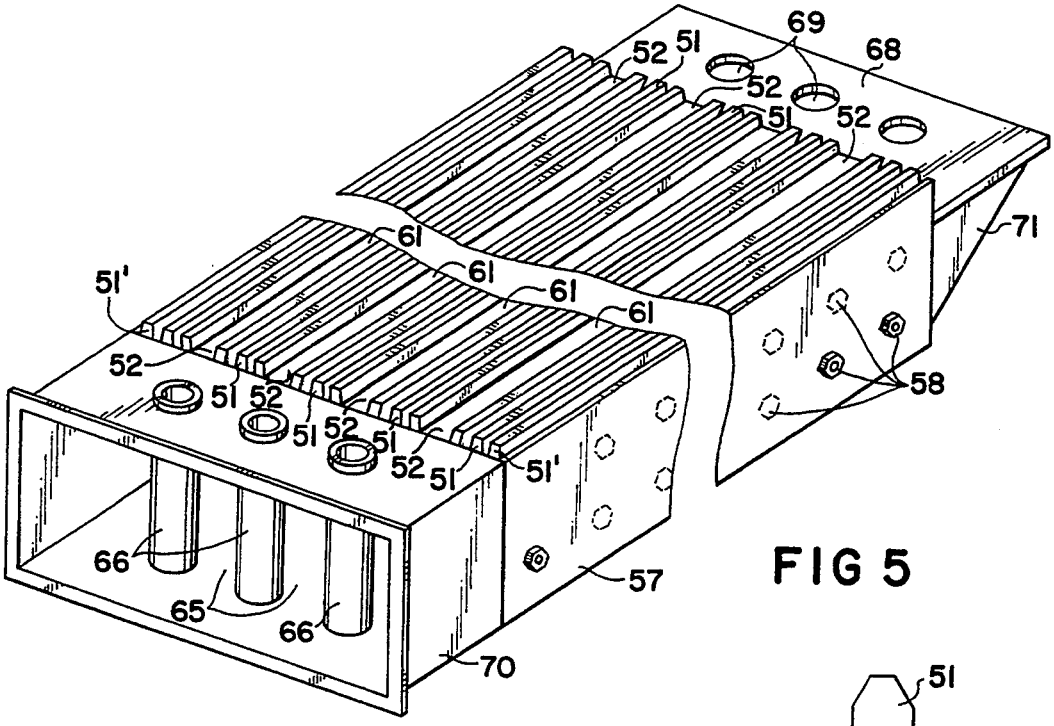
FIG. 5 is a perspective view of a multicell separator unit in accord with a second embodiment of this invention.
Figure 9:
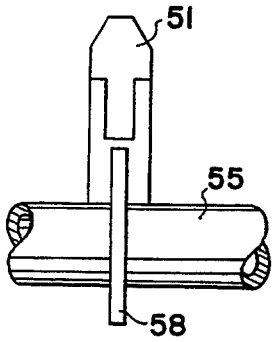
FIG. 9 is a front elevational view of the clamping device shown in FIG. 8.
Figure 8:
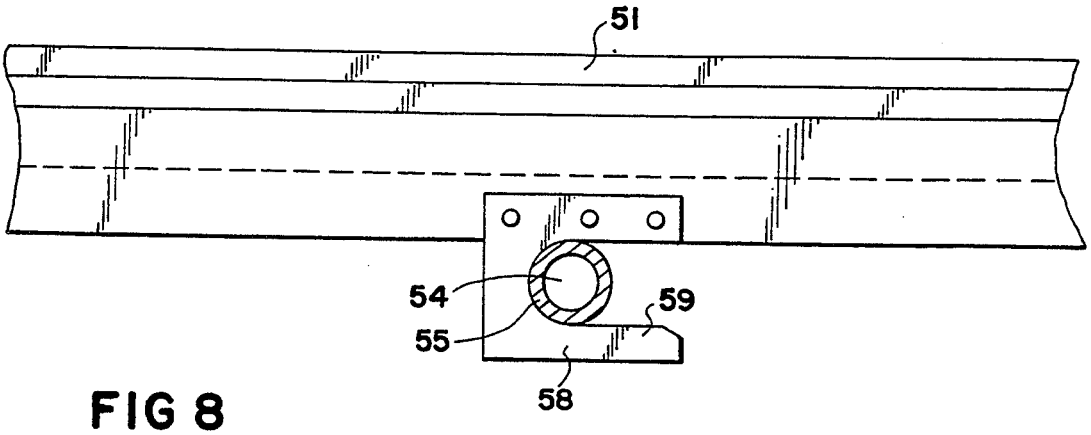
FIG. 8 is a side elevational view of a clamping device for a nose portion of the drainage multicell separator unit of FIG. 5.
Figure 6:
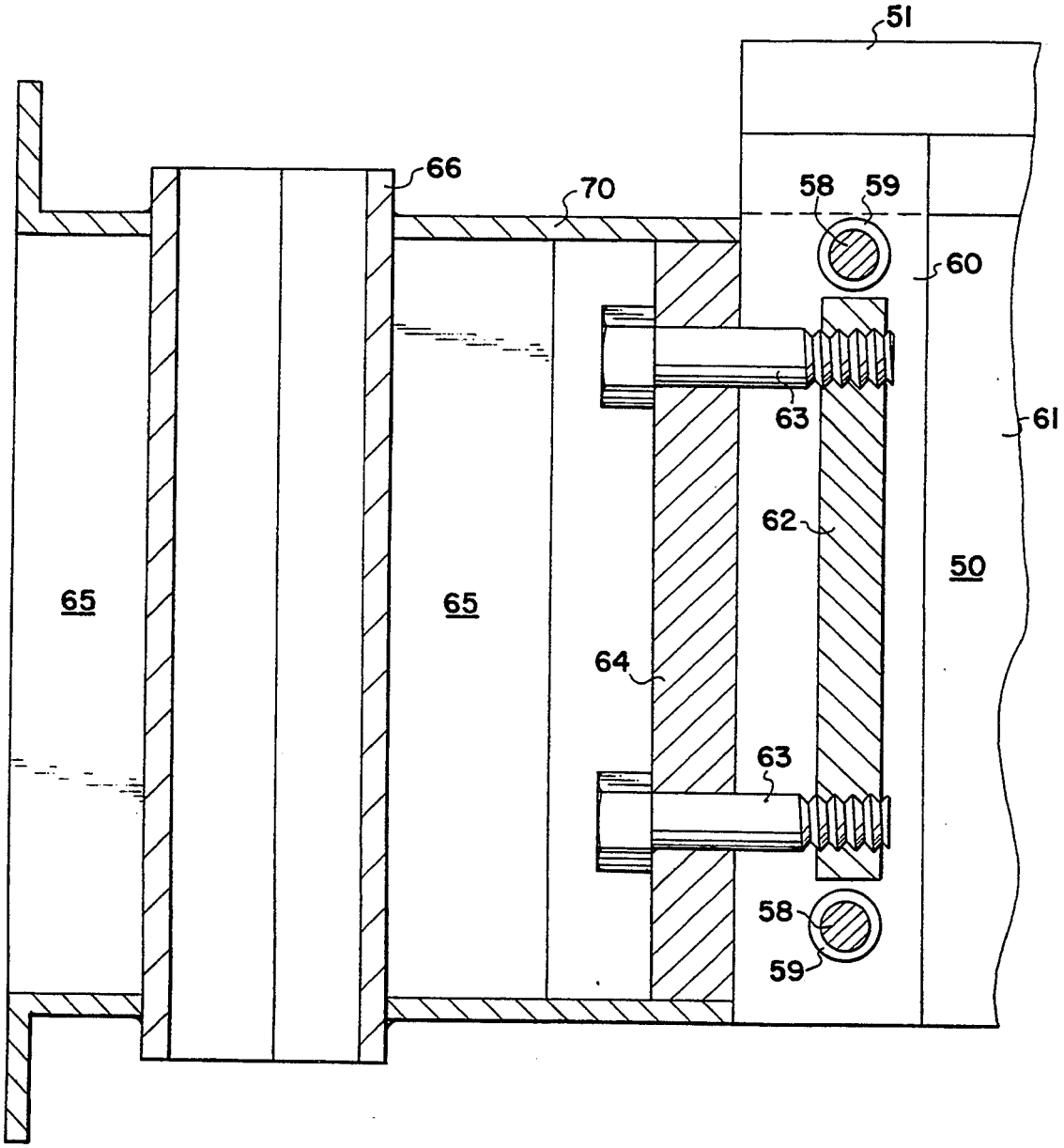
FIG. 6 is a cross sectional view of the near end of the drainage multicell separator unit of FIG. 5.

A plurality of cells 61 are assembled together, as shown in FIG. 5, to make a drainage multicell wire meniscus separator unit, such as any of 26–29 or 32–35. The assembly in FIG. 5 shows four cells 61 and optional end pieces 51′, with manifold cover 70 (see FIG. 6) attached to one end and closure cover 71 (see FIG. 7) attached to the other end. Manifold cover 70 encloses the open ends of chambers 50 of adjacent cells 61 to produce a single large passageway 65 that can be attached to a device to provide a vacuum in passageway 65 and chambers 50 to separate and remove water collected in chambers 50. Such devices are described and claimed in the above-mentioned U.S. Pat. No. 5,242,547. The opposite ends of chambers 50 are closed and covered by closure cover 71 (see FIG. 7). Each of covers 70 and 71 include a spacer plate 60 inserted between adjacent cells 61 with a flange 62 attached thereto and with holes to accommodate tie rods 58 and sleeve seals 59. Covers 70 and 71 are bolted to spacer plates 60 by bolts 63 screwed into tapped holes in flange 62. Bolts 63 are supported by plate 64 at the end covered by manifold cover 70 leaving free passage from chambers 50 to passageway 65. Bolts 63 in closure cover 71 are supported by the cover 67 since there is no passageway at this end for air and water in chambers 50. The entire assembly of separator unit of FIG. 5 is supported at each end so as to be properly positioned adjustably to be in contact with fabric 20 or 21. At the closed end cover 71 has a horizontal support plate with holes 69 to receive a bolt, rod, or whatever type of supporting structure is employed. At manifold end 70 the corresponding support is accomplished through tubes 66 welded into passageway 65 so as to prevent any leakage of the vacuum in passageway 65.

Figures 7, 11:
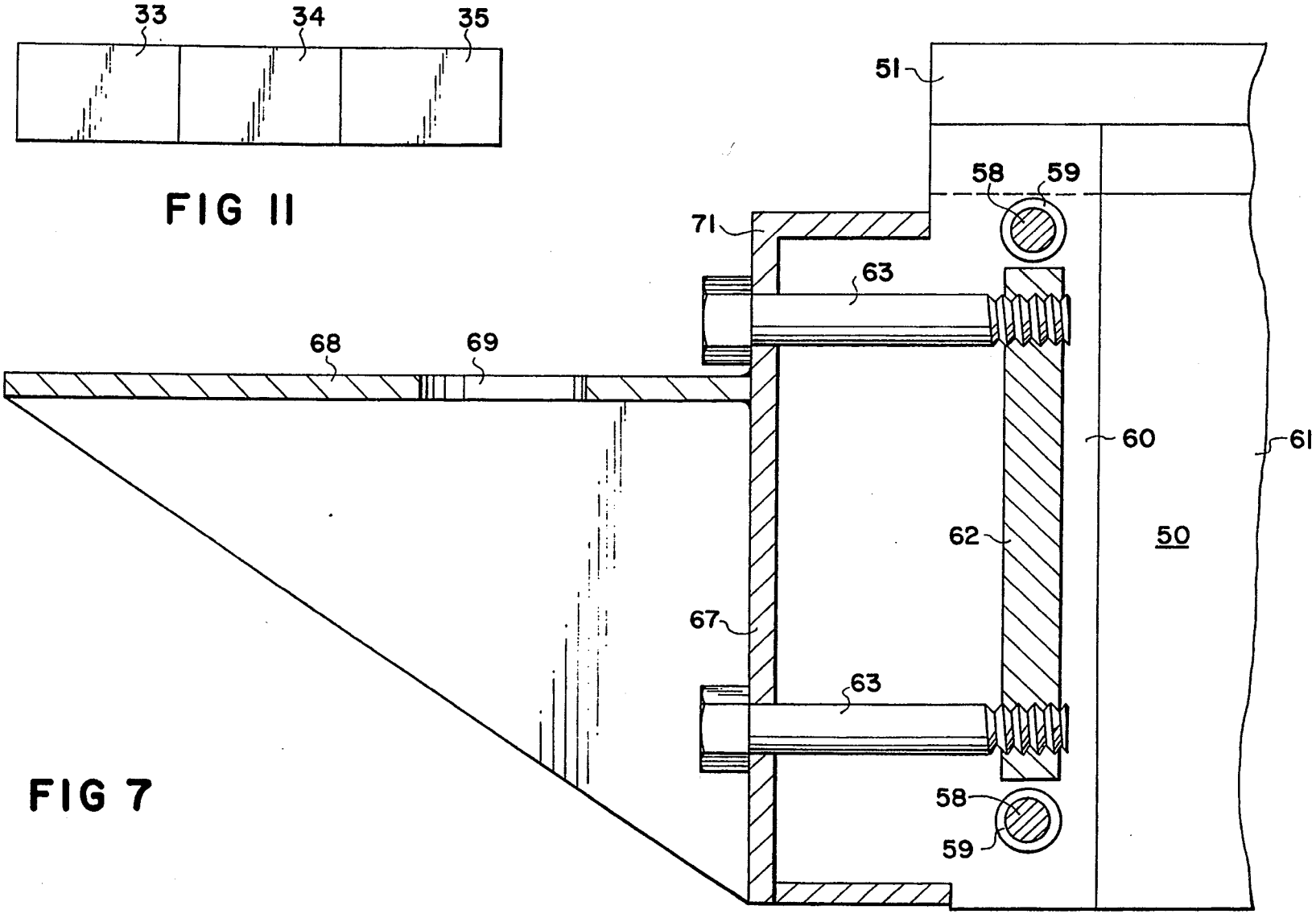
FIG. 7 is a cross-sectional view of the far end of the drainage multicell separator unit of FIG. 5.
FIG. 11 is a partial view of the drainage separator units of FIGS. 5 and 10 adjacent each other and forming an enlarged drainage unit assembly.

In FIG. 11 there is shown all three drainage separator units 33, 34 and 35 with unit 34 being sandwiched between adjacent units 33 and 35 and forming a series constituting an enlarged drainage unit assembly. Similarly, units 27, 28 and 29 may be assembled together and not spaced. Also, the units 27–29 and 33–35 may have a unitary outer frame with extended tie rods 54 and unitary manifold cover 70 and closure cover 71.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A drainage apparatus in combination with and for controlling the dewatering from a wet web of paper making fibers on a moving main Fourdrinier fabric about spaced breast and couch rolls and having adjacent the couch roll a drier end downstream of a wetter end adjacent the breast roll, said fabric having an outer surface, and an inner surface, said apparatus including a stationary first dewatering means along the wetter end for removing water through said fabric, said apparatus comprising an elongated stationary drainage multicell wire meniscus separator unit along the drier end of said fabric and having a drainage surface in continuous contact with said inner surface of said fabric, a web formed from an aqueous dispersion of paper making fibers supported on said outer surface of said fabric above said drainage separator unit, said drainage separator unit including a plurality of adjacent and spaced cells each from the next and each said cell having an internal space for discharging a volume of water and air, each said cell extending to and in contact with said inner surface of said fabric, each said cell having a first passageway means structured and arranged for conducting atmospheric air to said drainage surface of said separator unit and said inner surface of said fabric without air penetrating said web and between the inner surface of said wet web of paper in contact with said outer surface of said fabric and said inner surface of said fabric, each said cell having a second passageway means communicating from said drainage surface of said separator unit and said first passageway means through interstices of said fabric to said internal space of each of said cells, means for applying a small vacuum to said internal space of each of said cells to modify the natural tension of meniscus of water in said fabric so as to induce by capillary forces drainage of water from said web to said fabric and then, together with the atmospheric air introduced through said first passageway means, through said second passageway means into said internal space, said first and second passageways communicating for the passage of air only horizontally through said fabric, and means for discharging the water and air from said internal spaces of said cells.

2. The apparatus of claim 1 wherein each cell of said drainage multicell wire meniscus separator unit has a nose with a horizontal planar surface over which said inner surface of said fabric slides, said first passageway means of each cell being at an acute angle with said respective planar surface of each cell to conduct air between said inner surface and outer surface of said fabric in the same direction as the movement of said fabric, and said second passageway means of each cell being at an acute angle with said respective planar surface of each cell to conduct air and water away from said outer and inner surfaces of said fabric and said inner surface of said web into said internal space.

3. The apparatus of claim 1 further including a second Fourdrinier fabric being disposed above said main fabric and both being in contact with the same web of paper making fibers, said second fabric having a substantially identical spaced second drainage multicell wire meniscus separator unit as said separator unit, above and in contact with said second fabric for removing water from said web generally simultaneously through said second fabric.

4. The apparatus of claim 3 wherein water is removed by said separator unit at locations horizontally offset along said fabrics from said second separator unit.

5. A drainage apparatus in combination with and for removing water from a moving main Fourdrinier fabric having an outer surface and an inner surface and interstices therebetween for use in a paper making process, said apparatus including a stationary drainage multicell wire meniscus separator unit along a drier end of said fabric and having drainage surfaces in continuous contact with said inner surface of said fabric, a web formed of an aqueous dispersion of paper making fibers supported on said outer fabric surface above said separator unit, said separator unit including a plurality of spaced and adjacent cells each having an internal space for discharging a volume of water and air, each said cell extending to and in contact with said inner surface of said fabric, each cell having a first passageway structured and arranged for conducting atmospheric air to said drainage surface of said separator unit and said inner surface of said fabric without air penetrating said web and between the inner surface of said wet web of paper in contact with said outer surface of said fabric and said inner surface of said fabric, said cells being spaced along said fabric with adjacent said cells forming therebetween respective said first passageways, each said cell having a second passageway communicating from said drainage surface of said separator unit respectively to said internal space of each said cell and respectively with said first passageways through said interstices of said fabric, means for applying a small vacuum to said internal spaces of said cells to modify the natural tension of meniscus of water in said fabric so as to induce by capillary forces enhanced drainage of water from said web to said fabric and then, together with the atmospheric air introduced through said first passageways, into said internal spaces, and means for discharging the water and air from said internal spaces.

6. The apparatus of claim 5 wherein each said cell has a nose with a horizontal planar surface over which said inner surface of said fabric slides, said first passageways of each cell being at an acute angle with said respective planar surface of each cell to conduct air into said outer surface and said inner surface of said fabric in the same direction as the movement of said fabric, and said second passageway of each cell being at an acute angle with said respective planar surface of each cell to conduct air and water away from said outer and inner surfaces of said fabric and said inner surface of said web into said internal spaces.

7. The apparatus of claim 6 wherein each said drainage separator unit includes a plurality of tie rods extending through said cells in the direction of movement of said fabric, a clamping means to hold said series of cells together as a single rigid assembly, each said nose being formed as a thin nose supporting structure sandwiched between adjacent said cells, said nose supporting structure containing an open-ended slot engagable with one of said tie rods as an indexing and clamping component for positioning said nose with respect to said fabric.

8. The apparatus of claim 6 wherein said nose is truncated generally in the shape of a blunt arrow, a plurality of deflectors between and spaced apart from said noses the spaces between said nose of adjacent said cells and said adjacent deflectors constituting said first and said second passageways.

9. The apparatus of claim 8 wherein each said deflector contains an elongated keyway slot extending laterally of said fabric and parallel to said inner surface of said fabric, said drainage unit having a key engaging said keyway slot to hold said deflector rigidly in place.

10. The apparatus of claim 5 wherein said second passageways are located respectively downstream of said first passageways whereby air passing to said drainage surface of said separator unit is in the same direction of travel as said fabric to enhance water drainage from said web through said second passageways into said internal spaces.

11. The apparatus of claim 5 further characterized by a source of steam for heating the atmospheric air being conducted through said first passageway to enhance water drainage from said web.

12. The apparatus of claim 11 wherein said source of steam includes an elongated conduit with spaced openings' therethrough and extending generally oppositely from said first passageway, an elongated deflector spaced from and generally about said conduit, said deflector having an elongated opening whereby atmosphere air is drawn through said elongated opening heated by the steam emitting from said spaced openings of said conduit and thence through said first passageway.

13. The apparatus of claim 5 further including a second Fourdrinier fabric having an inner and outer surface disposed above said main fabric and both inner surfaces of said fabrics being in contact with the same web of paper making fibers, said apparatus further including identical spaced second drainage multicell wire meniscus separator unit above and in contact with said second fabric for removing water from said web generally simultaneously through said second fabric.

14. The apparatus of claim 13 wherein said drainage separator unit in contact with said another Fourdrinier fabric contain internal baffle means to prevent moisture inside said internal spaces from dropping by gravity into said second passageways therein.

15. The apparatus of claim 13 wherein water is removed by said cells of said separator unit associated with said main fabric are horizontally offset from said cells of said separator unit associated with said other fabric.

16. A drainage apparatus in combination with and for controlling the dewatering from a wet web of paper being made from fibers on a moving fabric supported on an outer surface of said fabric, said apparatus comprising an elongated stationary drainage multicell wire meniscus separator unit along said fabric and having a drainage surface in continuous contact with an inner surface of said fabric, said drainage separator unit including a plurality of spaced and adjacent cells, each of said cells having an internal space for discharging a volume of water and air, each said cell extending to and in contact with said inner surface of said fabric, each of said cells having a first passageway means structured and arranged for conducting atmospheric air to said drainage surface of said separator unit and said inner surface of said fabric and for inhibiting air from penetrating said web and between the inner surface of said wet web of paper in contact with said outer surface of said fabric and said inner surface of said fabric, each of said cells having a second passageway means communicating from said drainage surface of said separator unit and said first passageway means through interstices of said fabric to said internal space of respective said cells, means for applying a small vacuum to said internal spaces of all said cells to modify the natural tension of meniscus of water in said fabric so as to induce by capillary forces drainage of water from said web to said fabric and then, together with the atmospheric air introduced through said first passageway means, through said second passageway means into said internal space of each said cell, and means for discharging the water and air from said internal spaces of said cells.

17. The apparatus of claim 16 wherein said drainage multicell wire meniscus separator unit has a nose with a horizontal planar surface over which said inner surface of said fabric slides, said first passageway means of each cell being at an acute angle with said respective planar surface of each cell to conduct air between said inner surface and outer surface of said fabric in the same direction as the movement of said fabric, and said second passageway means of being at an acute angle with said respective planar surface of each cell to conduct air and water away from said outer and inner surfaces of said fabric and said inner surface of said web into said internal space.

18. The apparatus of claim 16 further including a second fabric being disposed above said fabric and both fabrics being in contact with said web, said second fabric having a substantially identical spaced second drainage multicell wire meniscus separator unit as said separator unit disposed above and in contact with said second fabric for removing water from said web generally simultaneously through said second fabric.

19. The apparatus of claim 18 wherein water is removed by cells of said drainage unit at locations horizontally offset along said fabrics from said cells of said second drainage unit.

20. The apparatus of claim 15 further characterized by a source of steam for heating the air being conducted through said first passageway to enhance water drainage from said web.

* * * * *